US006347810B1

(12) United States Patent
Dottel

(10) Patent No.: US 6,347,810 B1
(45) Date of Patent: Feb. 19, 2002

(54) FILE INTENDED FOR ALL TYPES OF DOCUMENTS, SUCH AS SHEETS OR LOOSE LEAVES, WHETHER PERFORATED OR NOT

(75) Inventor: Jean-Marc Dottel, Valenciennes (FR)

(73) Assignee: Achat et Distribution d'Article de Classement, SA, Valenciennes (FR)

( * ) Notice: Subject to any disclaimer, the term of this patent is extended or adjusted under 35 U.S.C. 154(b) by 0 days.

(21) Appl. No.: 09/519,343

(22) Filed: Mar. 6, 2000

(51) Int. Cl.[7] ..... B42F 13/00; B42D 1/00

(52) U.S. Cl. ..... 281/29; 220/324; 220/671; 220/675; 281/21.1; 281/22; 281/28; 281/37; 402/70; 402/73; 402/74; 402/80 R

(58) Field of Search ..... 220/324, 671, 220/675; 281/21.1, 22, 28, 29, 37; 402/70, 73, 80 R, 74

(56) References Cited

U.S. PATENT DOCUMENTS

| | | | | | |
|---|---|---|---|---|---|
| 1,887,530 | A | * | 11/1932 | Trussell | 402/73 |
| 4,294,558 | A | * | 10/1981 | Errichiello | 402/73 |
| 4,518,275 | A | * | 5/1985 | Rauch, III et al. | 402/80 R |
| 5,209,593 | A | * | 5/1993 | Ros | 402/77 |
| D341,625 | S | * | 11/1993 | Ros | 402/73 |
| D414,801 | S | * | 10/1999 | Karten et al. | 402/80 R |
| 5,971,650 | A | * | 10/1999 | Dottel | 402/73 |
| 6,030,140 | A | * | 2/2000 | Karten et al. | 402/73 |
| D435,591 | S | * | 12/2000 | Wyant | 402/73 |
| 6,200,057 | B1 | * | 3/2001 | Youngs et al. | 402/73 |
| 6,220,775 | B1 | * | 4/2001 | Dottel | 281/21.1 |

FOREIGN PATENT DOCUMENTS

| | | | |
|---|---|---|---|
| EP | 1168498 | * | 10/1969 |
| EP | 375925 | * | 11/1989 |
| GB | 2172548 A | * | 9/1986 |

* cited by examiner

*Primary Examiner*—Willmon Fridie, Jr.
*Assistant Examiner*—Mark T. Henderson
(74) *Attorney, Agent, or Firm*—Harrison & Egbert

(57) ABSTRACT

A file including a spine (2), from the longitudinal sides (3, 4) of which extend two lateral faces (5, 6) whereof the distal ends are shaped to form convergent wings (7, 8), and a closing means (9*a*, *9b*) so as to ensure the stability of said file in a vertical position because of the fact that its body closes back on itself, wherein a plurality of reinforcing ribs (10A, 10B et 14) are provided in sunken or protuberant form on at least one of its lateral faces (5, 6) so as to increase the rigidity of the whole.

16 Claims, 6 Drawing Sheets

FILE INTENDED FOR ALL TYPES OF DOCUMENTS, SUCH AS SHEETS OR LOOSE LEAVES, WHETHER PERFORATED OR NOT

TECHNICAL FIELD

The present invention relates to a file intended for all types of documents, such as sheets or loose leaves, whether perforated or not.

BACKGROUND ART

Conventional files generally consist of a back, or spine, and two planar lateral faces, extending on either side of said spine. They can be provided with attaching members, such as, rings enabling the documents filed to be held in place.

This type of product, although widely used, has, nonetheless, certain drawbacks due to the fact that the files are not very stable when they are placed vertically and as soon as they are relatively full.

This is why the the advancement developed for providing slots in one of the two lateral faces, said slots, having a special profile, being intended to cooperate with rings constituting attaching members, and balancing the files thus equipped.

The drawback of this type of file is that to make them is expensive on account of the mechanical means that have to be implemented, without providing a solution ensuring satisfactory stability.

A first solution to this problem was proposed by the Applicant in the form of a file having enhanced stability when in a vertical position.

The special feature of such a file is that it has lateral faces that are extended, at their distal ends, by wings that are convergent so as to ensure said stability in a vertical position, even when the file is full.

Such a solution to the problem initially posed should be considered as a definite improvement to the file of the aforementioned conventional type; nonetheless, it has proved necessary, in order to ensure satisfactory rigidity of the whole, to use a base material, generally plastic, of a certain thickness, or even to use double thick walls.

SUMMARY OF THE INVENTION

The object of the present invention is to provide a file that is as simple to manufacture as the above-described file, but which comprises means for reinforcing its structure that are capable of imparting thereto even greater rigidity, and consequently, better squareness, without reliance upon added, or built-on, means.

Another object of the invention is to provide a file wherein the material used to make it is no longer very thick, and it can be obtained by injection moulding a plastic material in a single operation, that is to say without any additional steps.

For this purpose, the invention describes a file consisting of a spine from the longitudinal sides of which extend two lateral faces whereof the distal ends are shaped to form convergent wings, and a closing The parts of the invention cooperate so as to ensure the stability of said file in a vertical position because of the fact that its body closes back on itself, wherein a plurality of reinforcing ribs are provided in sunken or protuberant form on at least one of its lateral faces so as to increase the rigidity of the whole.

The present invention also covers the characteristics that will emerge in the course of the following description, and which are to be considered either separately or in all the technical combinations possible.

This description, given by way of a non-limitative example, will make it easier to understand how the invention can be embodied with reference to the annexed drawings.

DETAILED DESCRIPTION OF THE INVENTION

Figure 1:
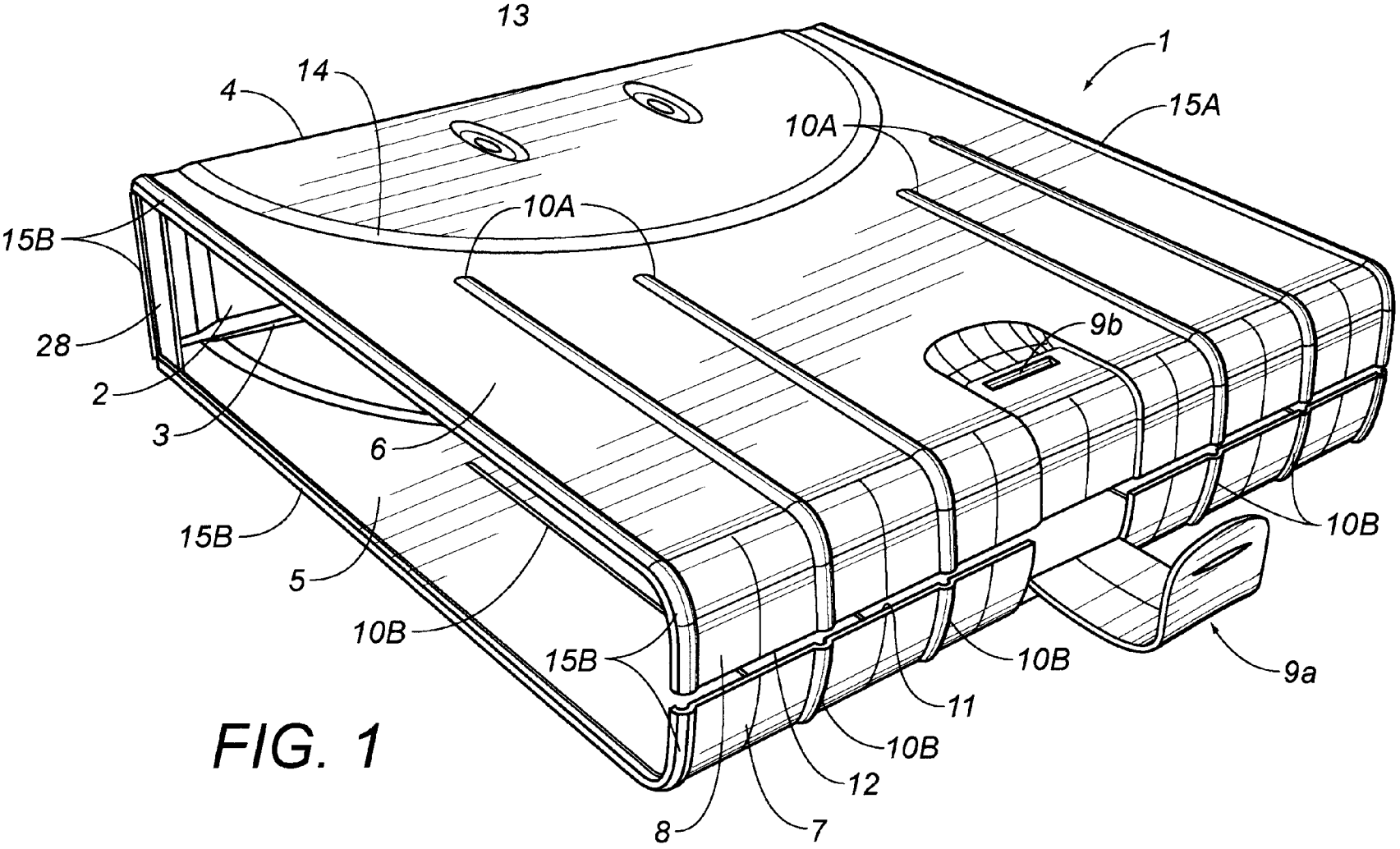
FIG. 1 is a perspective view of a reinforced file according to the invention in closed position.

File 1, generally represented in FIG. 1, consists of a spine, 2, which is rectangular, and from the longitudinal sides, 3 and 4, of which extend two lateral faces, 5 and 6.

The distal ends of lateral faces 5 and 6 are fashioned to form convergent wings, 7 and 8, which may be contiguous or otherwise, and have closing means, 9*a,* 9*b.*

As already mentioned, such a configuration enables the stability of said file 1 to be ensured when it is in the vertical position, because of to the fact that its body closes back on itself.

According to the invention, and to increase the rigidity of the whole, a plurality of reinforcing ribs are provided in sunken, 14, or protuberant, form on at least one of the lateral faces. Rigidity will, of course, be enhanced by the presence of the ribs on both faces 5 and 6.

More precisely, as shown in FIG. 1, ribs 10A, 10B are produced in a transverse direction and extend in the same way on convergent wings 7 and 8.

According to another characteristic of the invention, transverse ribs 10A, 10B of each of lateral faces 5 and 6 are discontinued at a certain distance from spine 2 in order to leave free a surface, 13, intended for the production of a rib 14, running in a different direction, in an area proximal to said spine 2.

According to a first exemplary embodiment, represented in FIG. 1, rib 14 proximal to spine 2 describes an arc of a circle the chord of which is formed by a longitudinal edge 4 of spine 2.

According to another exemplary embodiment, not shown, the transverse and parallel ribs on one lateral face extend uninterruptedly over the spine and then onto the other lateral face to close back on themselves in the area of the junction edges of the wings.

According to another characteristic of the invention, the upper and lower edges of spine 2, of lateral faces 5, 6 and of wings 7, 8 defining corresponding open sides, are reinforced by an inwardly and outwardly directed double end rib, 15A, 15B.

According to another characteristic of the invention, transverse ribs 10A and 10B, provided at least on lateral faces 5 and 6, and extending over the contiguous wings, in this case 7 and 8, to meet up in the area of their junction edges 11 and 12, comprise, in their facing planes, complementary means for positioning and/or connecting one in relation to the other, so as to permit co-operation between ribs 10A on one face and ribs 10B on the other face when the file is closed, thus, the ribs consolidate the general squareness of file 1, in particular by making them integral with one another.

Figure 2:
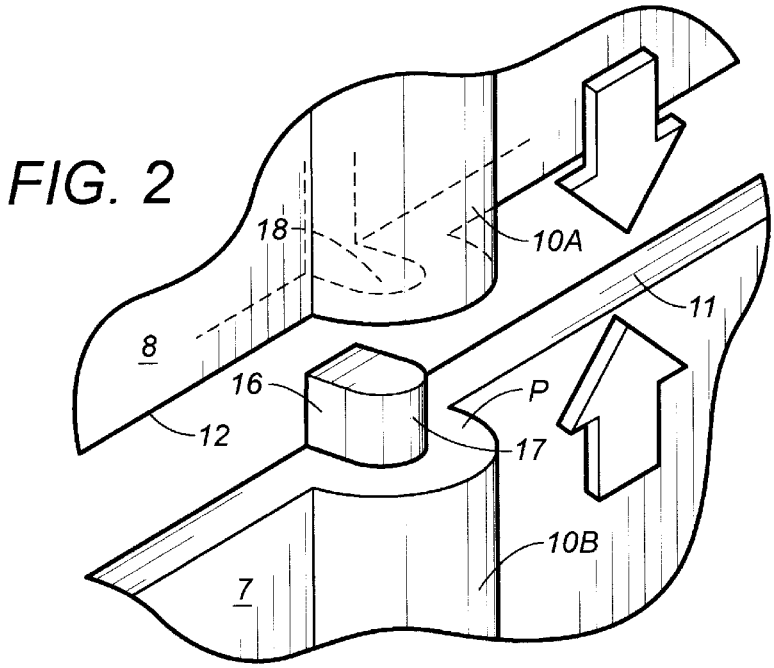
FIG. 2 is a larger-scale detail view of a means for positioning and connecting the lateral edges of the file prolonging its lateral faces, in open position.
Figure 3:
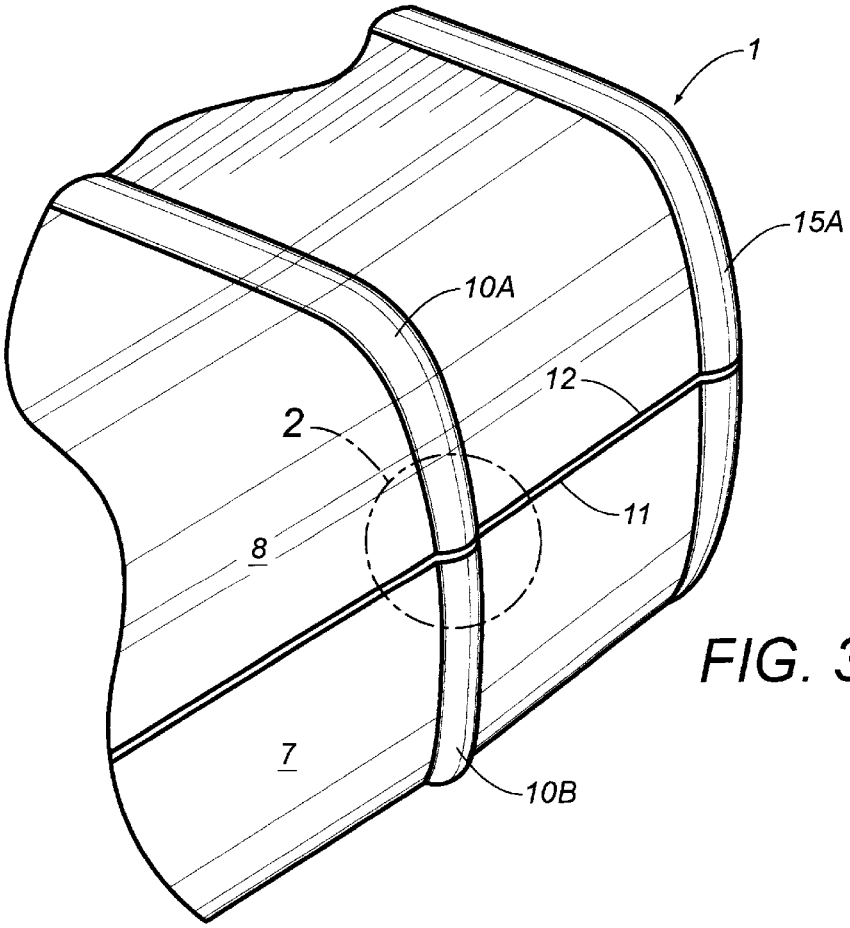
FIG. 3 is a perspective view showing the wings in closed position, provided with the means of FIG. 2.

According to a first form of embodiment, illustrated in FIGS. 2 and 3, these means for positioning and/or connecting one rib 10A in relation to another rib 10B are consist of a mortise-and-tenon system, formed by a projection, or pin, 16, extending from plane P of rib 10B, having a cross-section that is smaller than that of the latter, and forming a parallelopiped-shaped base, one portion of which, directed towards the outer surface of a rib 10B is prolonged by a semicylindrical portion, 17. Said pin 16 is capable of co-operating with a recess, 18, of a complementary shape provided on the end of the other rib 10A with which it is designed to connect in closed condition.

Said pin 16 may possibly be extended, width-wise, towards spine 2 of the file and/or height-wise, towards the lateral face bearing the rib from which it extends.

Such pins 16 may be provided, if necessary, on each of the convergent wings so as to produce alternation, with one said pin 16 being followed, on the same wing, by one said recess 18, the other wing being equipped accordingly, opposite.

Figure 4:
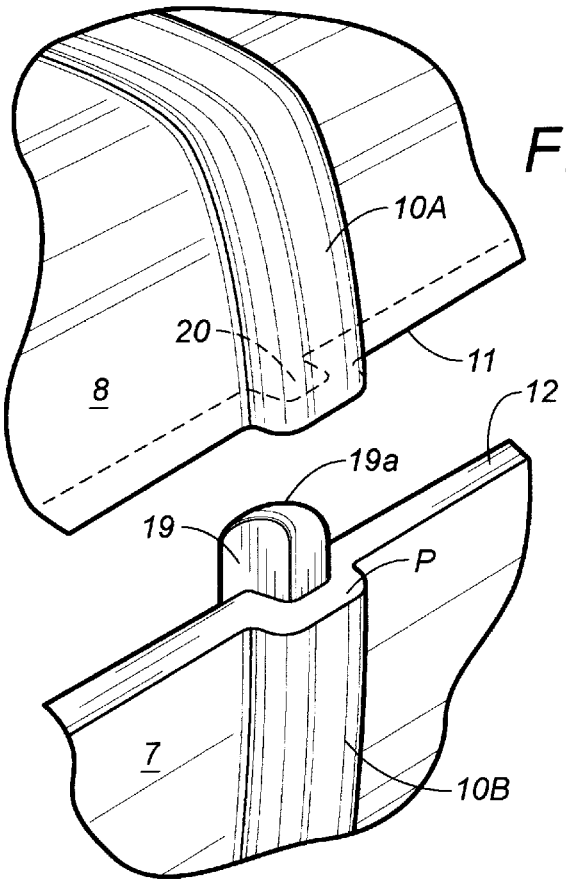
FIG. 4 is a larger-scale perspective view of means for positioning and connecting the wings according to a second form of embodiment, in open position.
Figure 4A:
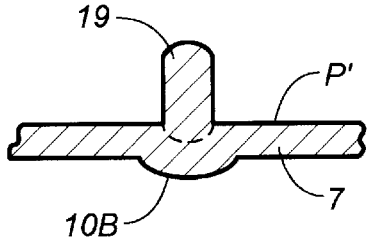
FIG. 4A shows a partial cross-section of one of the wings of the file equipped with the positioning and connecting means of FIG. 4.

According to a second form of embodiment, illustrated in FIG. 4, said means for positioning and/or connecting one rib, 10A, in relation to another rib, 10B, are formed by a pin, 19, provided inside a protuberant rib 10B and extending both from upper plane P thereof and from inner plane P' of wing 7 on which it is formed. It is formed in such a way as to constitute a raised reinforcement capable of co-operating with a recess, 20, of a complementary shape provided on the end of the other rib, 10A, with which it is designed to connect in closed condition.

As shown in FIG. 4, pin 19 has two flat lateral sides and a semicylindrical apex, 19*a*.

Figure 5:
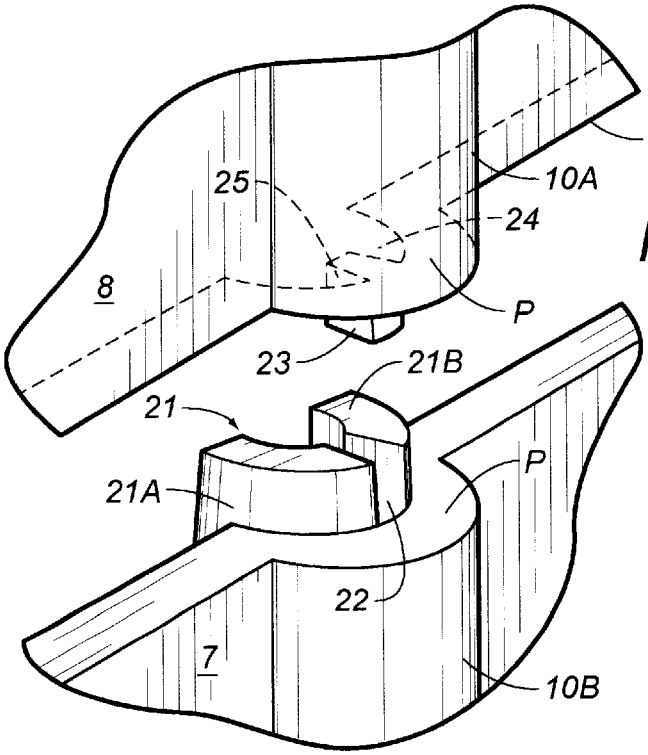
FIG. 5 is a larger-scale perspective view of means for positioning and connecting the wings according to a third form of embodiment, in open position.
Figure 5A:
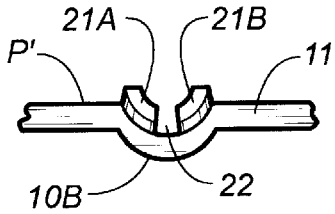
FIG. 5A shows a partial cross-sectional view of one of the wings of the file equipped with the positioning and connecting means according to FIG. 5.

According to a third form of embodiment, shown in FIG. 5, said means for positioning and/or connecting a rib 10A in relation to another rib 10B consist of a pin, 21, formed in two parts, 21A, 21B, provided inside a protuberant rib 10B and extending both from plane P thereof and from inner plane P' of wing 7 on which it is formed.

The two parts 21A, 21B of a pin 21 are generally in the shape of cylindrical ring, or crown. Sectors spaced apart from one another define a mortise, 22, suitable for receiving a tenon, 23, of a corresponding shape provided in relief on plane P of the other rib, 10A.

Connection is accomplished by fitting a tenon 23 of one rib 10A into the mortise 22 of the other rib 10B, with this taking place at the same time as cylindrical crown sectors 21A, 21B of this same rib 10B are fitted into two hollow inner portions, 24, 25, of the other rib 10B located on either side of its tenon 23.

Figure 6:
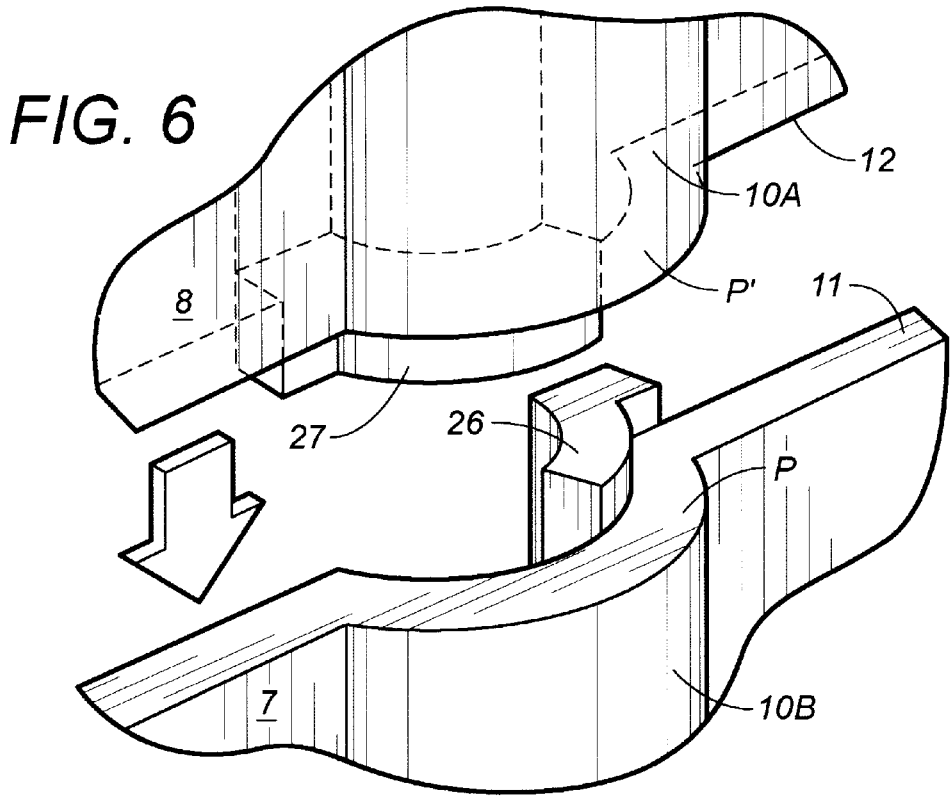
FIG. 6 is a larger-scale perspective view of means for positioning and connecting the wings according to a fourth form of embodiment, in open position.

According to a fourth form of embodiment, shown in FIG. 6, the means for positioning and/or connecting a rib 10A in relation to another rib 10B consist of by two complementary pins, 26, 27, provided head to tail respectively inside a protuberant rib 10B and inside another, similar, rib 10A located opposite. Pins 26, 27 are generally in the shape of cylindrical crown sectors and extend both from the respective planes P and P' of each rib 10A, 10B and from the respective inner plane of each wing 7 and 8, in such a way as to join up in complementary fashion in closed condition by fitting respectively into the remaining free inner portions of said ribs so as to be contiguous at all points.

According to another characteristic of the invention, the general consolidation of squareness can be enhanced via at least one inner tongue, 20 28, or 33-34, extending from the inner face of spine 2 in the immediate vicinity of its longitudinal edges 3 and 4, and in its lower and/or in its upper area, to constitute an abutment and bearing surface for lateral faces 5 and 6 in closed condition.

Figure 7:
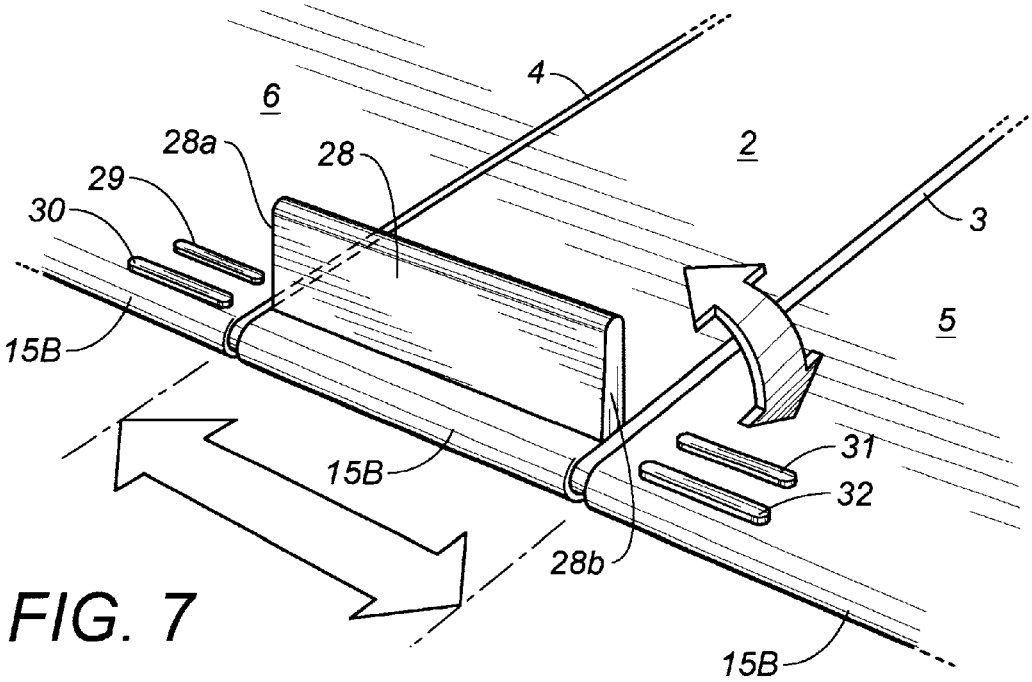
FIG. 7 is a perspective detail view of a part of the spine showing consolidating means in the area of the spine of the file.

As more specifically shown in FIG. 7, according to a first exemplary embodiment, tongue 28, constituting the inner means of abutment for faces 5 and 6, is generally parallelopiped-shaped and disposed transversely to spine 2 over the width of the latter to meet up with its two longitudinal edges 3 and 4.

As can also be seen from FIG. 7, the lateral ends, 28*a*, 28*b*, of each tongue 28 on spine 2, directed towards lateral faces 5 or 6, are sandwiched, in closed condition, by projections 29, 30 and 31, 32, provided transversely on the inside of said lateral faces 5 and 6 and spaced to match the width of tongue 28, so as to contribute to enhancing the squareness of the whole.

Figure 8:
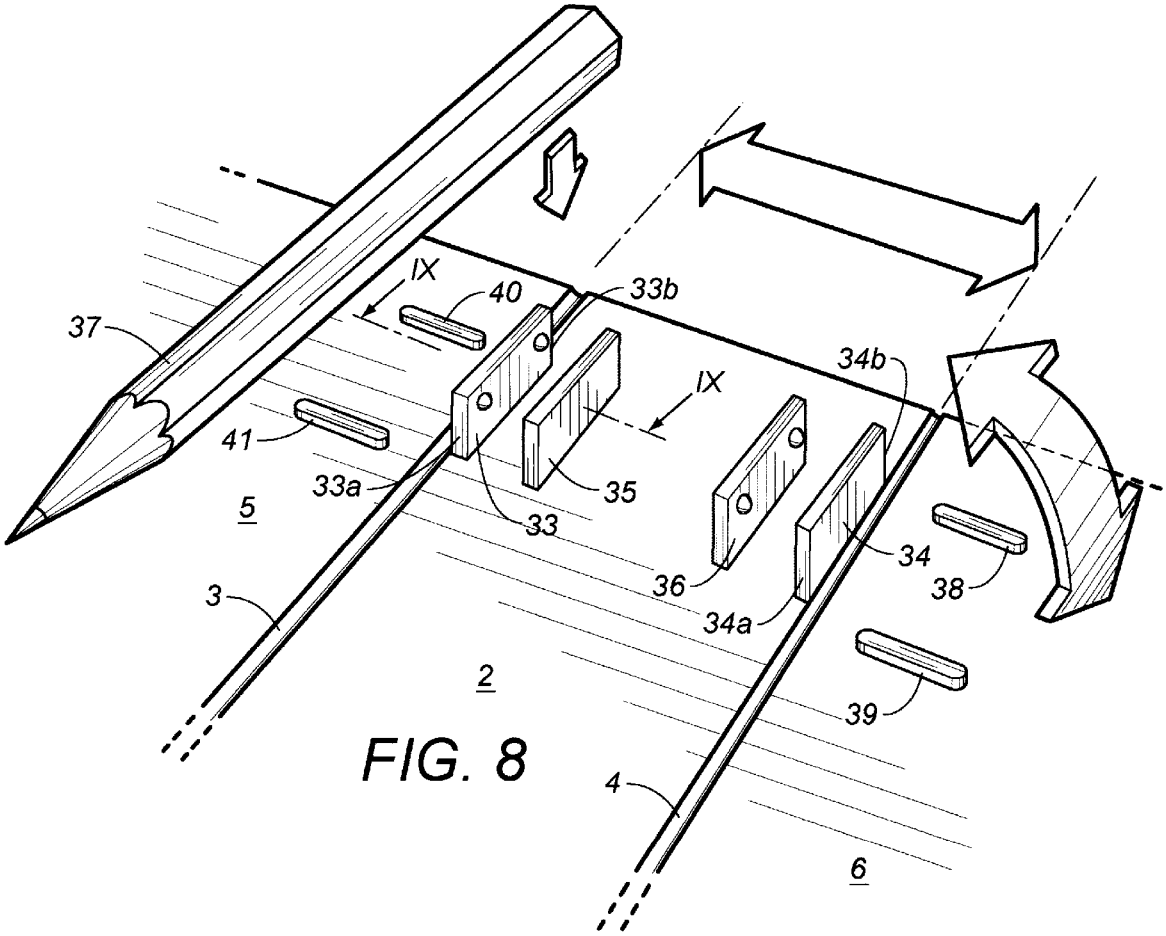
FIG. 8 shows a spine in perspective view, equipped with consolidating means according to an alternative embodiment.

According to an alternative embodiment, illustrated in FIG. 8, spine 2 comprises two abutment means disposed on its inner face in its upper area and in its lower area, these being constituted by two tongues, 33, 34, generally parallelepiped-shaped disposed longitudinally and opposite, and in the immediate vicinity of the longitudinal edges 3, 4 of said spine 2.

According to an improvement of this same form of embodiment, at least one of longitudinal tongues 33, 34 is matched with a second longitudinal tongue, 35, 36, which is parallel thereto, and in particular spaced therefrom by an amount substantially equal to that of the diameter of a pencil, 37, so as to provide a support for the latter.

Figure 9:
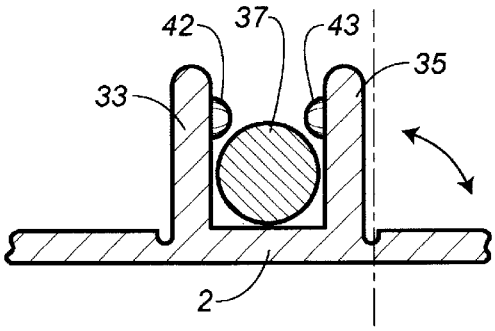
FIG. 9 is a cross-sectional view along line IX—IX of FIG. 8.

As more particularly illustrated in FIG. 9, tongues 33 and 35 cooperate at their upper free ends with bead members, 42 and 43, enabling pencil 37 to be retained after passing through them as permitted by elastic deformation.

Again according to the form of embodiment illustrated in FIG. 8, the lateral ends, 33*a*, 33*b* or 34*a*, 34*b* of each tongue 33 or 34 of spine 2 perpendicular to lateral faces 5 or 6 are sandwiched, in closed condition, between projections 38, 39, 40, 41, provided transversely on the inside of said lateral faces 5 and 6, and spaced apart by a distance corresponding to the length of tongues 33, 34 so as to reinforce the squareness of the whole.

Figure 10:
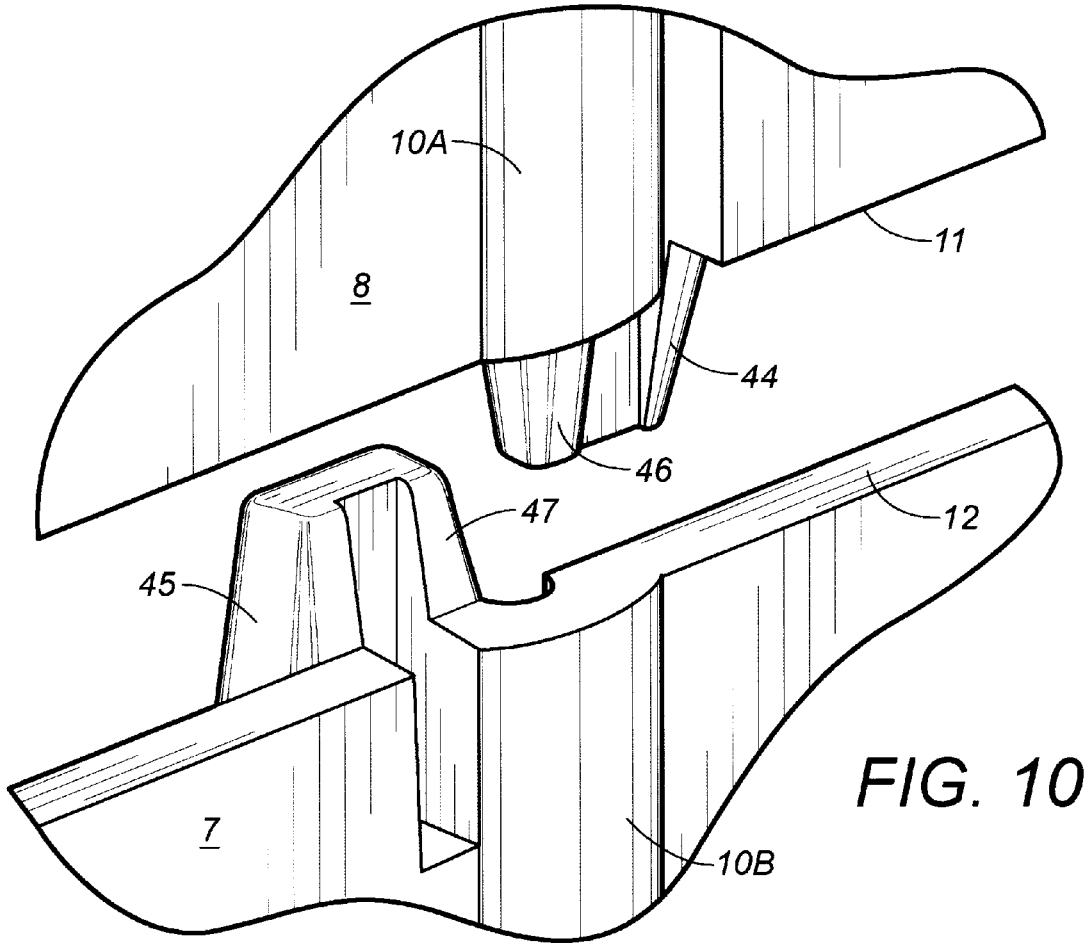
FIG. 10 is a larger-scale perspective view of means for positioning and connecting the wings according to another form of embodiment, in open position.
Figure 10A:
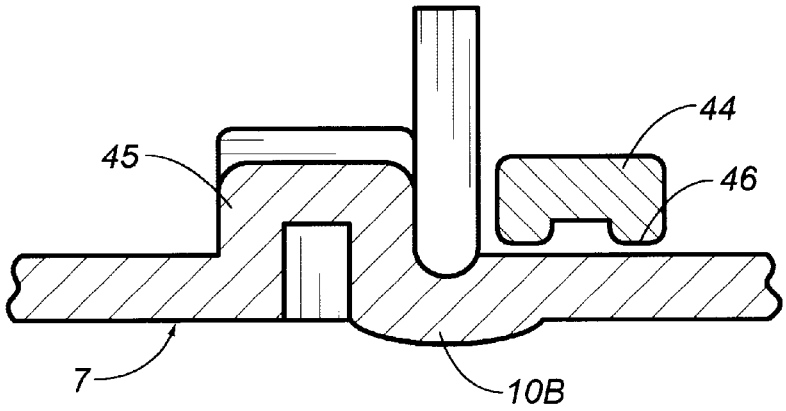
FIG. 10A is a partial cross-sectional view of one of the wings of the file equipped with the positioning and connecting means of FIG. 10.

According to another form of embodiment, illustrated in FIG. 10, said complementary positioning means provided in the area of ribs 10A, 10B are formed by pins 44, 45, in particular having the shape of a quadrangular pyramid trunk, provided so as to project and to stand back in relation to the junction edges 11, 12 of wings 7, 8. When the file is closed, the inclined faces, 46, 47, of pins 42, 43 co-operate with the respective inner faces of opposite wings 7, 8 in order to prevent an inner and/or outer overlap of the latter while, at the same time, enabling a certain amount of play to be compensated for.

In this case, there is no complementary relation between said pins 44, 45, which, moreover, renders them less fragile, but there is co-operation, in closed position, between pins 44, 45, wings 7, 8 and closing means 9*a*, 9*b*, and even squaring tongues 28; 33 through 36, and 38 through 41, to ensure that the file closes with satisfactory rigidity and squareness of the whole, by holding wings 7, 8 opposite one another.

The exemplary embodiments illustrated in the figures relate to a file comprising ribs which are, for the most part, protuberant. These ribs could, of course, also be sunken and possess the same characteristics as those described above.

Furthermore, by way of illustration, the depth or the thickness of a rib is 2 mm and the thickness of the lateral faces is, because of the invention, not more than 2 mm. Furthermore, the peripheral double rib 15 is 6 mm wide, for example, that is to say it projects 2 mm on either side of the lateral face, said face, as indicated above, being 2 mm thick.

In this connection, said file consist of a thickness of material, in particular mouldable plastic, in which ribs 10, 14, tongues 28 or 33 to 44 and/or the projections mentioned earlier, among others, are produced in the body of the material.

I claim:

1. A file apparatus comprising:

a spine having a first longitudinal side and a second longitudinal side;

a first lateral face extending from said first longitudinal side, said first lateral face having an end opposite said first longitudinal side;

a second lateral face extending from said second longitudinal side, said second lateral face having an end opposite said second longitudinal side, the ends being shaped to form respective convergent wings;

a closing means formed on the ends for securing one of said first and second lateral faces in a closed position relative to the other of said first and second lateral faces; and a first plurality of reinforcing ribs formed on at least one of said first and second lateral faces, said first plurality of reinforcing ribs extending transversely to the longitudinal sides and extending along said convergent wings, said first plurality of reinforcing ribs extending parallel to each other, said first plurality of reinforcing ribs extending uninterruptedly over said spine and onto the other of said first and second lateral faces.

2. The file apparatus of claim 1, further comprising:

a second plurality of reinforcing ribs formed on the other of said first and second lateral faces, each of said second plurality of reinforcing ribs corresponding in location to each of said first plurality of reinforcing ribs said first and second pluralities of reinforcing, ribs extending so as to meet respectively at a junction of said convergent wings.

3. The file apparatus of claim 1, each of said first plurality of reinforcing ribs being discontinued at a distance from said spine so as to define a free space on the lateral face, the apparatus further comprising:

a rib member extending in a different direction than said first plurality of reinforcing ribs and at a location adjacent said spine.

4. The file apparatus of claim 1, further comprising:

an inner tongue extending from an inner face of said spine adjacent said first and second longitudinal edges, said inner tongue being in abutment with said first and second lateral faces when in said closed position.

5. The file apparatus of claim 3, said rib member being of an arc shape having a chord edge defined by a longitudinal edge of said spine.

6. The file apparatus of claim 4, said inner tongue being of a generally parallelpiped shape and extending transversely to a longitudinal axis of said spine.

7. The file apparatus of claim 4, said inner tongue comprising:

a first tongue disposed at an upper area on said inner face of said spine, said first tongue being parallelpiped shaped and disposed longitudinally adjacent said first longitudinal edge of said spine; and a second tongue disposed at a lower area on said inner face of said spine, said second tongue being parallelpiped shaped and disposed longitudinally adjacent said second longitudinal edge of said spine.

8. The file of apparatus of claim 7, each of said first and second tongues having a longitudinal member spaced therefrom in parallel relationship thereto.

9. The file apparatus of claim 7, each of said first and second tongues having opposite lateral ends, each of said opposite lateral ends being sandwiched between projections provided on an interior of the respective lateral faces, said projections being spread apart by a distance corresponding to a dimension of the respective tongue sandwiched therebetween.

10. A file apparatus comprising:

a spine having a first longitudinal side and a second longitudinal side;

a first lateral face extending from said first longitudinal side, said first lateral face having an end opposite said first longitudinal side;

a second lateral face extending from said second longitudinal side, said second lateral face having an end opposite said second longitudinal side, the ends being shaped to form respective convergent wings;

a closing means formed on the ends for securing one of said first and second lateral faces in a closed position relative to the other of said first and second lateral faces;

a first plurality of reinforcing ribs formed on at least one of said first and second lateral faces, said first plurality of reinforcing ribs extending transversely to the longitudinal sides and extending along said convergent wings, said first plurality of reinforcing ribs extending parallel to each other, said first plurality of reinforcing ribs extending uninterruptedly over said spine and onto the other of said first and second lateral faces;

a first end rib extending along an edge of spine and along an edge of said first lateral face and along an edge of one of said convergent wings, said first end rib extending inwardly and outwardly;

a second end rib extending along another edge of said spine and along an opposite edge of said second lateral face and along an opposite edge of the other of said convergent wings, said second end rib extending inwardly and outwardly.

11. A file apparatus comprising:

a spine having a first longitudinal side and a second longitudinal side;

a first lateral face extending from said first longitudinal side, said first lateral face having an end opposite said first longitudinal side;

a second lateral face extending from said second longitudinal side, said second lateral face having an end opposite said second longitudinal side, the ends being shaped to form respective convergent wings;

a closing means formed on the ends for securing one of said first and second lateral faces in a closed position relative to the other of said first and second lateral faces;

a first plurality of reinforcing ribs formed on at least one of said first and second lateral faces, said first plurality of reinforcing ribs extending transversely to the longitudinal sides and extending along said convergent wings, said first plurality of reinforcing ribs extending parallel to each other, said first plurality of reinforcing ribs extending uninterruptedly over said spine and onto the other of said first and second lateral faces;

a second plurality of reinforcing ribs formed on the other of said first and second lateral faces, said first and second pluralities of reinforcing ribs having respective ends meeting at a junction area between edges of said convergent wings; and a complementary means formed on said respective ends of said first and second pluralities of reinforcing ribs, said complementary means for positioning each of the ribs of said first plurality with respect to corresponding ribs of said second plurality when said first and second lateral faces are in said closed position.

12. The file apparatus of claim 11, said complementary means comprising:

a pin extending from a planar surface at an end of one said first and second pluralities of reinforcing ribs, said pin having a cross-sectional area smaller than the cross-sectional area of the rib from which said pin extends; and a recess of a shape complementary to said pin extending into a planar surface at an end of a corresponding rib of the other of said first and second plurality of reinforcing ribs, said pin being receivable in said recess when said lateral faces are in said closed position.

13. The file apparatus of claim 12, said pin being formed within the rib of said one of said first and second pluralities of reinforcing ribs, said pin extending along an inner surface of one of said convergent wings.

14. The file apparatus of claim 12, said pin being formed of two parts formed within the rib of said one of said first and second pluralities of reinforcing ribs, said two parts being of cylindrical crown sectors spaced from each other so as to define a mortise therebetween, the corresponding ribs of said other of said first and second pluralities of reinforcing ribs having a tenon extending therefrom, said tenon being received by said mortise when said lateral faces are in said closed positions, said recess defining two inner hollow portions located on sides of said tenon, said two inner hollow portions respectively receiving said two parts when said lateral faces are in said closed position.

15. The file apparatus of claim 12, said pin having an edge extending longitudinally into a recess formed into said one of said first and second pluralities of reinforcing ribs, said recess having a corresponding pin extending outwardly therefrom, said corresponding pin having a longitudinal edge in side-by-side relationship with said pin when said lateral faces are in said closed position.

16. The file apparatus of claim 12, said pin projecting rearwardly of one of said convergent wings, said pin cooperative with an inner surface of the other of said convergent wings so as to prevent an overlap of respective edges of said convergent wings.

* * * * *